US006072432A

United States Patent [19]

Powell et al.

[11] Patent Number: 6,072,432

[45] Date of Patent: Jun. 6, 2000

[54] HYBRID POWER TAPERED/SPACE TAPERED MULTI-BEAM ANTENNA

[75] Inventors: Charles M. Powell, Holland, Pa.; Warren Frederick Hunt, Bartlett, Ill.; Dirk Hartung, Perros Guirec, France

[73] Assignee: Radio Frequency Systems, Inc., Marlboro, N.J.

[21] Appl. No.: 08/850,243

[22] Filed: May 2, 1997

[51] Int. Cl.[7] ..... H01Q 3/22

[52] U.S. Cl. ..... 342/373

[58] Field of Search ..... 342/373, 372; 343/820, 813, 814

[56] References Cited

U.S. PATENT DOCUMENTS

| | | | |
|---|---|---|---|
| 3,474,447 | 10/1969 | Melancon | 343/100 |
| 3,701,157 | 10/1972 | Uhrig | 343/708 |
| 3,836,970 | 9/1974 | Reitzig | 343/100 |
| 3,858,218 | 12/1974 | Masak et al. | 343/106 |
| 3,997,900 | 12/1976 | Chin et al. | 343/100 |
| 4,032,922 | 6/1977 | Provencher | 343/854 |
| 4,062,019 | 12/1977 | Woodward et al. | 343/797 |
| 4,063,243 | 12/1977 | Anderson et al. | 343/100 |
| 4,231,040 | 10/1980 | Walker | 343/100 |
| 4,316,192 | 2/1982 | Acoraci | 343/100 |
| 4,495,502 | 1/1985 | Masak | 343/380 |
| 4,596,986 | 6/1986 | Andrews et al. | 343/373 |
| 4,633,257 | 12/1986 | Apostolos et al. | 342/445 |
| 4,814,775 | 3/1989 | Raab et al. | 342/373 |
| 4,882,588 | 11/1989 | Renshaw et al. | 342/373 |
| 4,905,014 | 2/1990 | Gonzalez et al. | 343/909 |
| 5,115,248 | 5/1992 | Roederer | 342/373 |
| 5,162,804 | 11/1992 | Uyeda | 342/373 |
| 5,248,984 | 9/1993 | Sezai | 342/427 |
| 5,255,004 | 10/1993 | Berkowitz et al. | 343/853 |
| 5,293,175 | 3/1994 | Hemmie et al. | 343/795 |
| 5,293,176 | 3/1994 | Elliot | 343/797 |
| 5,345,248 | 9/1994 | Hwang et al. | 343/895 |
| 5,353,032 | 10/1994 | Bertocchi et al. | 342/373 |
| 5,416,490 | 5/1995 | Popovic | 343/700 |
| 5,418,544 | 5/1995 | Elliot | 343/797 |
| 5,471,224 | 11/1995 | Barkeshli | 343/909 |
| 5,479,176 | 12/1995 | Zavrel, Jr. | 342/374 |
| 5,589,843 | 12/1996 | Meredith et al. | 343/820 |
| 5,675,343 | 10/1997 | Champeau | 342/378 |

OTHER PUBLICATIONS

"IEEE Standard Definitions of Terms for Antennas," IEEE Std 145–1983, pp. 1–29.

*Primary Examiner*—Mark Hellner

*Attorney, Agent, or Firm*—Ware, Fressola, Van Der Sluys & Adolphson LLP

[57] ABSTRACT

An antenna system producing a multi-beam antenna pattern having reduced sidelobe levels with a uniform beam pattern includes an antenna having a plurality of co-linear arrays of radiating elements including central co-linear arrays each of which has an identical number of radiating elements and a pair of outermost co-linear arrays each having a single radiating element. Each of the central co-linear arrays receives the full power output from a corresponding output of a Butler-matrix feed network except for two of the central radiating elements adjacent to the two outermost co-linear arrays, which each share the output power from a corresponding one of the outputs from the Butler-matrix feed network with one of the outermost co-linear arrays. In particular the power is shared between one of the outermost co-linear arrays and a corresponding one of the central co-linear arrays adjacent to the other outermost co-linear array utilizing a power splitter which splits the power between the corresponding central co-linear array and the outermost co-linear array. Each co-linear array includes a feed strap interconnected to each element in the co-linear array. The feed straps for the central co-linear arrays implement an identical trim configuration, and the feed straps for the outermost co-linear arrays introducing a phase shift of $\lambda/2$, where $\lambda$ is the wavelength of the electromagnetic energy to be received or transmitted.

14 Claims, 8 Drawing Sheets

HYBRID POWER TAPERED/SPACE TAPERED MULTI-BEAM ANTENNA

TECHNICAL FIELD

The present invention is directed to antenna systems having antenna arrays and feed mechanisms for use therewith, particularly where such antenna systems are used for cellular communications, personal communications systems and other high frequency applications.

BACKGROUND OF THE INVENTION

In the cellular communication art, land mobile radio networks transmit and receive high frequency signals (greater than 800 MHz) via antennas located at land mobile radio sites. In order to maximize the geographic area for coverage of the signal, the effective radiated power (ERP) must be maximized. The ERP is the product of the power input to the antenna times the gain factor of the antenna; that is, the solid angle direction of the transmission and reception path of the antenna.

It is known in the art that in order to have high ERP while reducing the absolute power into the antenna, the antenna must necessarily have a high gain factor. In order to increase the gain of an antenna, the physical aperture, that is the height and width of the antenna, must increase and the antenna's beam, as defined by the solid cone angle, must necessarily occupy fewer steradians. Thus for instance, an antenna might have a vertical beam width of 4°, while the horizontal beam width may be 30°. These beam widths define the antenna's radiating beam solid cone angle. Typically, the smaller the beam solid cone angle, the higher the gain of the antenna.

For cellular communication applications, it is generally required, depending upon the location of the land mobile radio site, to cover 360° of azimuth while the vertical beam width may only be 4° degrees in order to effectively cover a geographic area. However, in order to cover 360° of azimuth and maintain high gain, it is typically necessary to use twelve antennas with 30° of horizontal beam width each. The cost of such antennas and the availability of mounting space for such antennas present significant difficulties. Furthermore, this number of antennas can present windloading problems at the antenna tower, as well as provide a detrimental visual appearance.

In order to overcome the problems associated with providing twelve antennas with 30° of horizontal beam width each, it is known in the land mobile radio industry to produce multiple antenna patterns (a multi-beam pattern) out of a common aperture using a Butler-matrix feed network. Such a matrix consists of a phasing network with N inputs and N outputs, where N can be any integer greater than one. This phasing network serves to take each of the N inputs and divide the signal amongst the N output ports with each output port having a fixed phase offset with respect to the other output ports. By properly adjusting the phases between adjacent antennas, the output lobe from the antenna can be electrically steered to the left or right in a controlled fashion. Each of the N inputs creates a different set of phase shifts on the N outputs and therefore results in N distinct "beams" from a common aperture. Such an antenna is sometimes referred to as a phased array antenna. FIG. 1 illustrates an example of this phase-shifting arrangement for 8 inputs and 8 outputs (N=8). A discussion of the Butler-matrix feed is presented in "Antenna Engineering Handbook", 2nd edition, Richard C. Johnsen and Henry Jassick, McGraw-Hill Book Company, pps. 20–56 through 20–60.

Since it is not necessary to have separate antenna apertures to make all of the required antenna beams, the Butler-matrix feed approach greatly reduces the problems associated with the visual appearance of a plurality of antennas, with the concomitant reduction in windloading, as well as some cost savings with regard to mounting space. One approach for an antenna driven by such a Butler-matrix is shown in FIG. 2, which illustrates four (4) rows or sets of four co-linear arrays of radiating elements, yielding a 4×4 panel of radiating elements.

The beam widths, sidelobe levels and grating lobes of an antenna comprising N co-linear arrays of N radiating elements driven by an N beam Butler-matrix feed network are defined by the physics of the overall antenna system. Thus the spacing between the co-linear arrays of radiating elements (in wavelengths of the radiating or received energy) drive the grating lobes while the sidelobes are driven by the spacial Fourier transform of the antenna aperture width and the radiating element spacing within each of the co-linear arrays. For four vertically polarized co-linear arrays of radiating elements at 0.5 wave length horizontal spacing (between adjacent arrays), the sidelobes are approximately 7 dB below the main lobe. Even if the number of co-linear elements per array is increased vertically, such as to 8, such an arrangement does not change the sidelobe level relative to the main lobe. A −7 dB sidelobe is a significant problem for cellular communications due to the fact that it does not provide the azimuthal beam pattern required for land mobile radio system operation.

It has been shown through the use of Monte Carlo Analysis Programs conducted at U.S. West New Vector Group in Bellevue, Wash. that −10 dB sidelobe levels are the maximum levels which can be adequately tolerated for such land mobile radio system operation. Thus, the standard arrangement of an antenna with four co-linear arrays of four radiating elements each, connected to a Butler-matrix feed network is not suitable for such communication.

One approach to dealing with the problems associated with high sidelobe levels is by controlling the power delivered to each co-linear array of radiating elements, and reducing the power level to the outermost beams while maintaining a high power level for the inner beams to thereby decrease sidelobe levels. FIG. 3 is an example of such an antenna system utilizing an amplifier between each output of the Butler-matrix which feed the individual co-linear arrays of radiating elements. The gain of the amplifiers is selected such that lower power is provided to the outermost co-linear arrays of radiating elements, e.g., −3 dB with respect to the central co-linear arrays. A reduction in power to the outermost co-linear arrays relative to the inner co-linear arrays is sometimes referred to as power tapering. A problem associated with such an arrangement is that the amplifiers are active elements and are susceptible to failure. Such an arrangement also presents a significant maintenance problem if the amplifiers are located in a tower of a mobile radio base site adjacent to the antenna. It is much simpler to service and maintain an amplifier that is located remotely from an antenna, for example at the base of a tower in the cellular base site. Another problem associated with such an arrangement is the potential distortion (intermodulation distortion) introduced by the multitude of amplifiers. Additionally, such an arrangement is more expensive and complicated.

A second method of decreasing the sidelobe levels of a phased array antenna is disclosed in commonly owned U.S. Pat. No. 5,589,843. This patent discloses decreasing the sidelobe level by reducing the number of co-linear radiating elements at the outer edge of the multi-co-linear array antenna which is driven by a microstrip implemented Butler-matrix network feed. As illustrated in FIG. 4, in such an antenna, the absolute gain of the antenna decreases slightly because the physical aperture is slightly smaller. The reduction of the number of co-linear elements for the co-linear arrays toward and at the edges of the antenna is sometimes referred to as space tapering. Such space tapering is highly desirable with regard to the reduction of sidelobe levels.

Such a space tapered antenna provides the significant advantage of reduced sidelobe level at the expense of providing a beam pattern which is not as uniform as the beam pattern produced by such an antenna having an equal number of radiating elements in the various co-linear arrays, such as the antenna of FIG. 2.

SUMMARY OF THE INVENTION

Objects of the invention include the provision of a multi-co-linear array antenna driven by a microstrip implemented Butler-matrix network feed having reduced sidelobe levels while providing a uniform beam pattern.

In order to provide such an antenna having reduced sidelobe levels with a uniform multi-beam pattern, an antenna is provided having a plurality of co-linear arrays of radiating elements including central co-linear arrays each of which has an identical number of radiating elements and a pair of outermost co-linear arrays each having a single radiating element, and wherein each of the central co-linear arrays receives the full power output from a corresponding output of a Butler-matrix feed network except for two of the central radiating elements adjacent to the two outermost co-linear arrays, which each share the output power from a corresponding one of the outputs from the Butler-matrix feed network with one of the outermost co-linear arrays.

In further accord with the present invention, the power is shared between one of the outermost co-linear arrays and a corresponding one of the central co-linear arrays adjacent to the other outermost co-linear array utilizing a power splitter which splits the power between the corresponding central co-linear array and the outermost co-linear array.

In still further accord with the invention, each co-linear array includes feed strap means interconnected to each element in each co-linear array, the feed strap means for the central co-linear arrays implementing an identical trim configuration, and the feed strap means for the outermost co-linear arrays introducing a phase shift of $\lambda/2$, where $\lambda$ is the wavelength of the electromagnetic energy to be received or transmitted.

According further to the present invention, the spacing between adjacent elements in the central co-linear arrays is preferably approximately $\lambda$, where $\lambda$ is the wavelength of the electromagnetic energy to be received or transmitted. The spacing between adjacent co-linear arrays is typically approximately $\lambda/2$, and in one particular example of the invention is $0.47\lambda$.

The present invention provides a significant improvement over the prior art by providing a multi-co-linear array antenna having reduced sidelobe levels with a uniform beam pattern. The significant reduction in sidelobe levels is accomplished by the combination of providing only a single radiating element in the outermost co-linear arrays while at the same time splitting the power output from an output of the Butler-matrix feed network between an outermost co-linear array and an inner co-linear array. In particular, in accordance with the invention, the power split is performed between one outermost co-linear array and one of the inner co-linear arrays adjacent to the other outermost co-linear array. It has been found that such a configuration provides the significant reduction in sidelobe level while at the same time providing the desired uniform beam pattern.

In order to achieve the desired radiating pattern having uniform beams with significantly reduced sidelobe levels in accordance with the present invention, a microstrip implemented Butler-matrix feed network is used in combination with an antenna having only a single radiating element in its outermost co-linear arrays with the remaining co-linear arrays each having an identical number of radiating elements in order to achieve a high gain antenna with reduced sidelobe levels and uniform beam pattern which is particularly advantageous for use in land mobile radio applications, including cellular radio communications and PCS communications.

The foregoing and other objects, features and advantages of the present invention will become more apparent in light of the following detailed description of exemplary embodiments thereof as illustrated in the accompanying drawings.

BEST MODE FOR CARRYING OUT THE INVENTION

Figure 1:
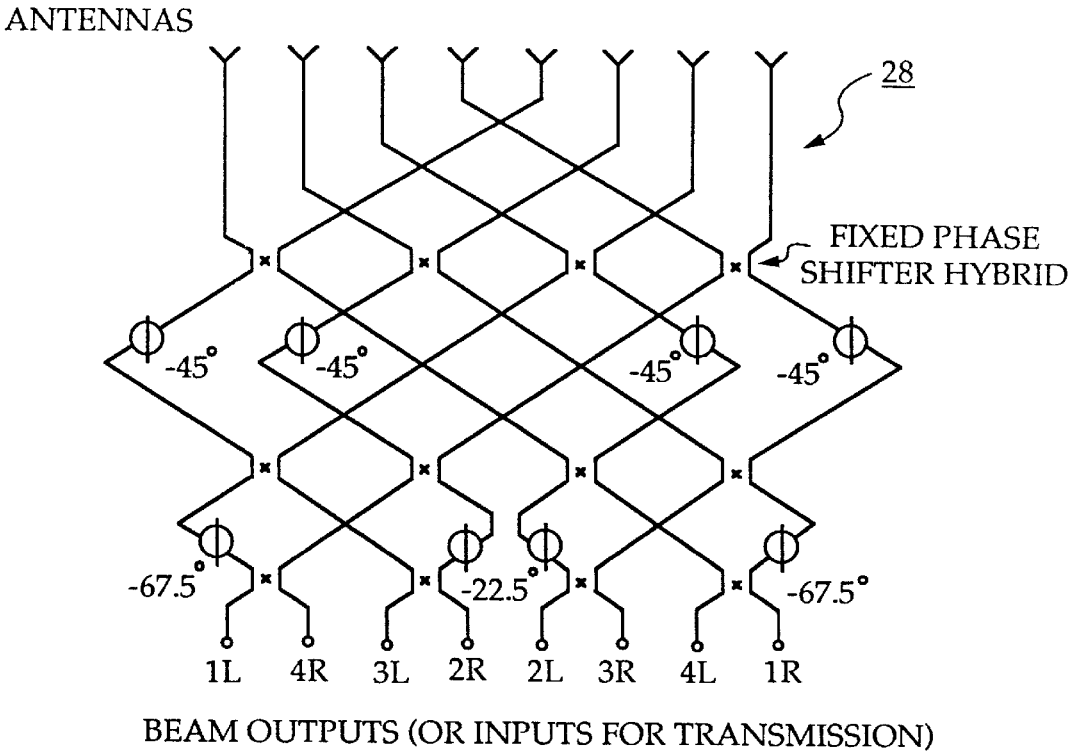
FIG. 1 PRIOR ART
FIG. 1 illustrates a prior art Butler-matrix feed network comprising N inputs and N outputs, where N is equal to 8.
Figure 2:
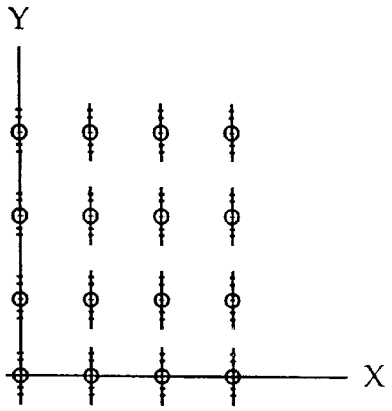
FIG. 2 PRIOR ART
FIG. 2 is a diagrammatic representation of a prior art antenna with four co-linear arrays, in which co-linear array comprises for the radiating elements.
Figure 3:
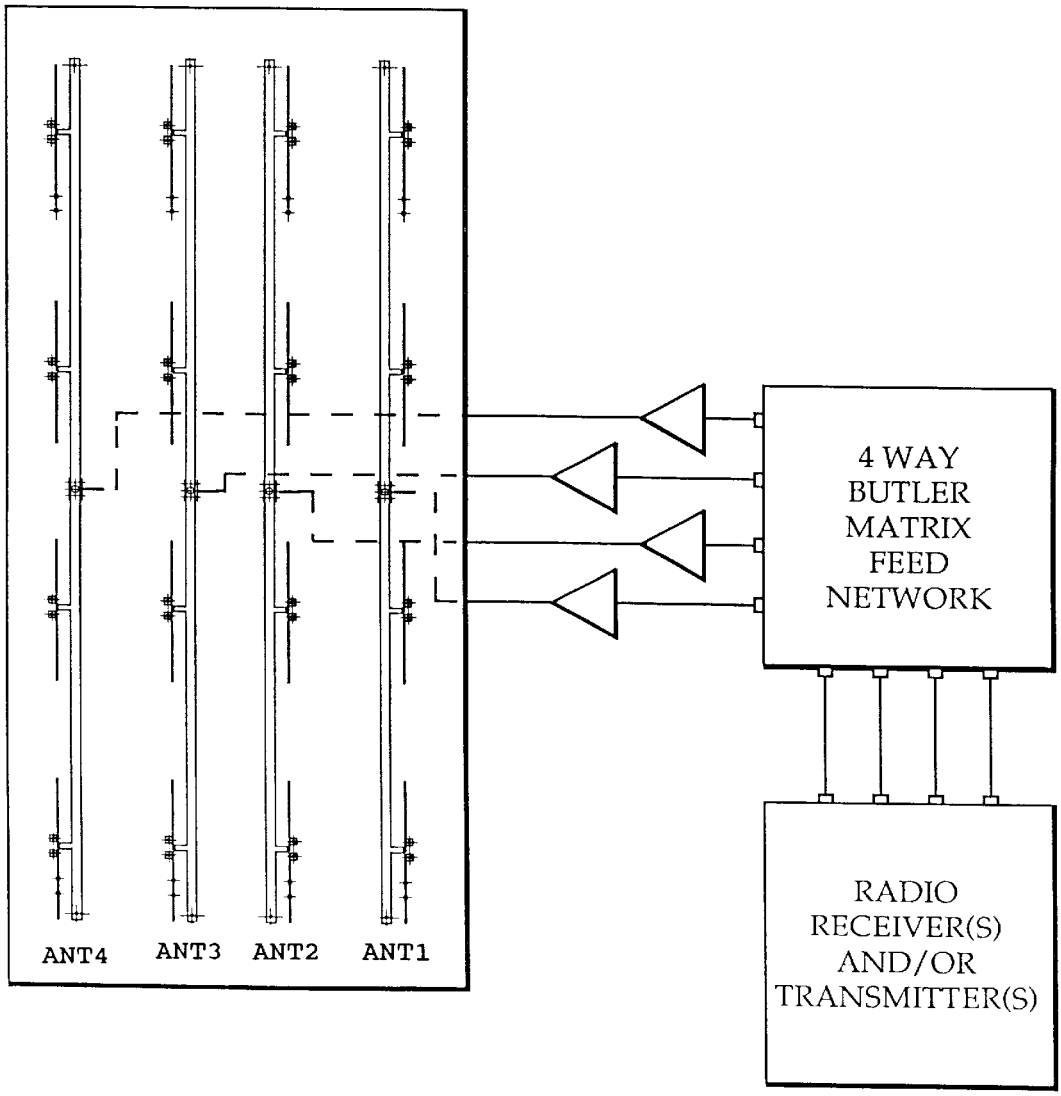
FIG. 3 PRIOR ART
FIG. 3 is a diagrammatic representation of a prior art antenna system including a power tapered antenna comprising four co-linear arrays wherein amplifiers are used to feed the individual co-linear arrays of the antenna, the gain of the amplifiers being adjusted to provide the desired antenna pattern.
Figure 4:
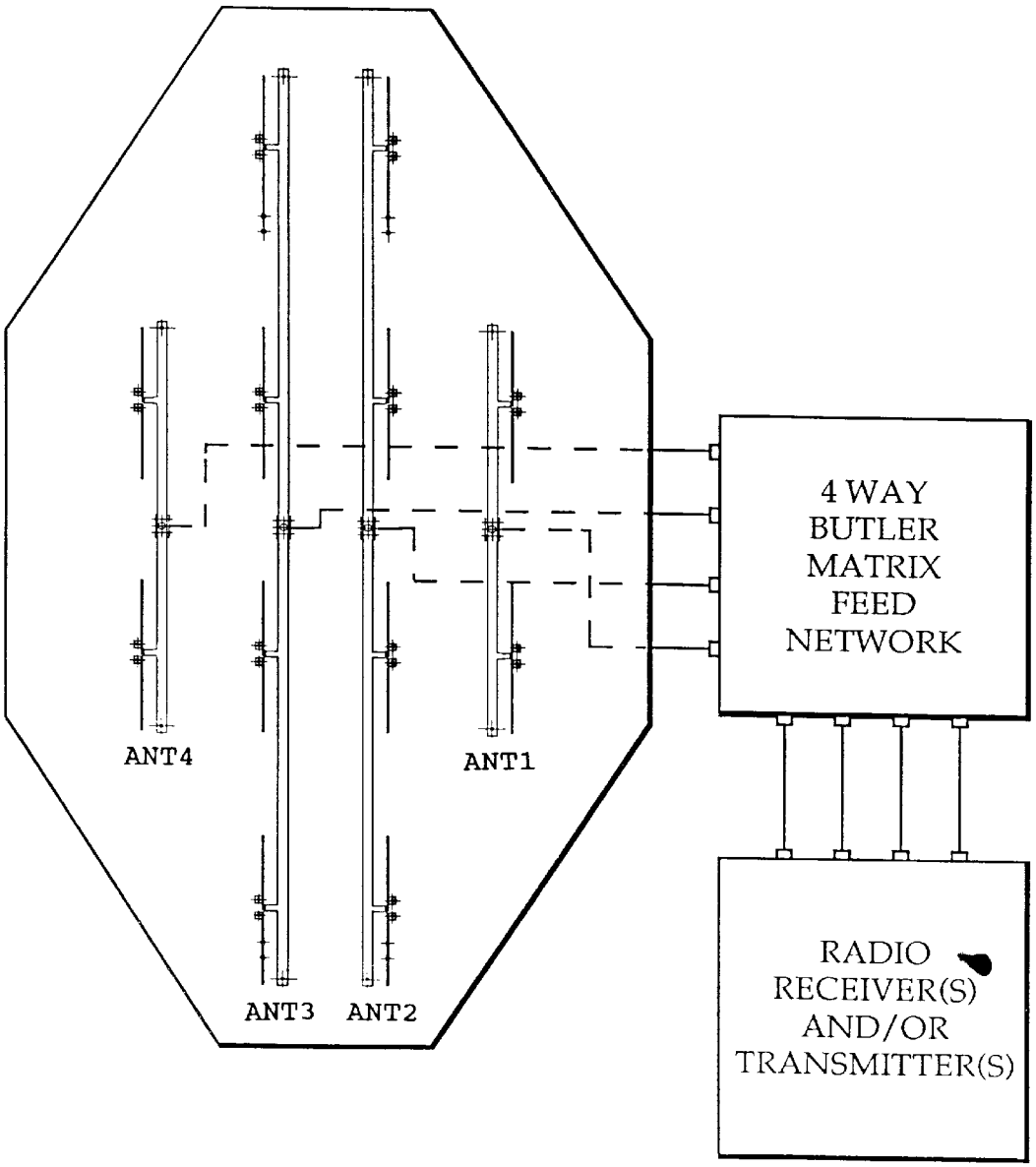
FIG. 4 PRIOR ART
FIG. 4 is a diagrammatic representation of a prior art antenna system including a space tapered antenna comprising four co-linear arrays wherein the outermost co-linear arrays each have two radiating elements and wherein the inner arrays each have four radiating elements, fed by a 4-way Butler-matrix feed network forming part of the antenna system.
Figure 5:
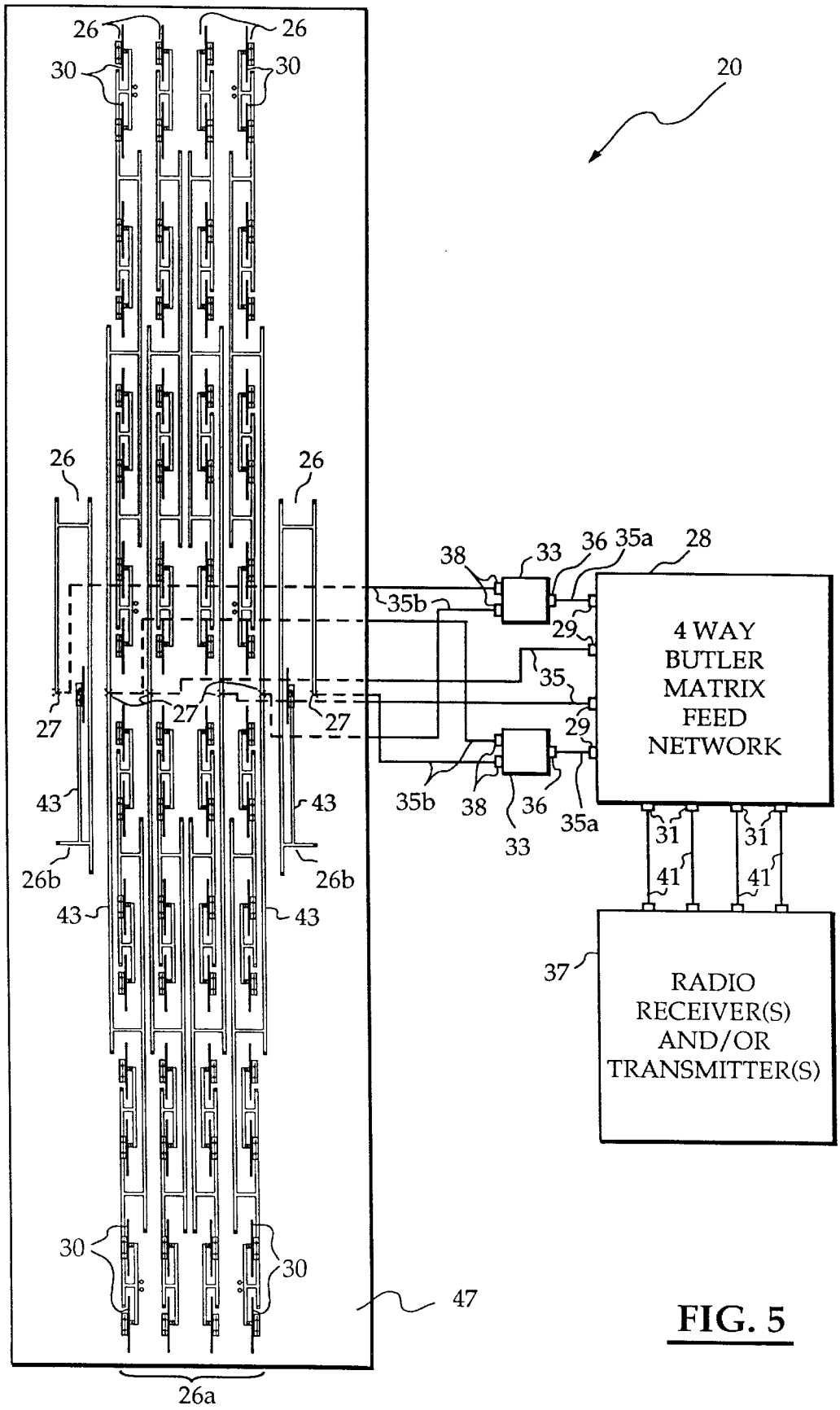
FIG. 5 is a diagrammatic representation of an embodiment of an antenna system according to the present invention, illustrating a hybrid power tapered/space-tapered antenna, comprising four central co-linear arrays and two outermost co-linear arrays, wherein the two outermost co-linear arrays each have one radiating element, and wherein the inner arrays each have sixteen (16) radiating elements, a 4-way Butler-matrix feed network forming part of the antenna system; and radio receiver(s) and/or transmitter(s) connected to the Butler-matrix feed network, the receiver(s) and/or transmitter(s) not forming part of the antenna system.

As best seen in FIG. 5, the present invention is directed to an improved antenna system 20 which comprises two major components; namely, a hybrid power tapered/space tapered multi-beam antenna 24 and a Butler-matrix feed network 28. The embodiment of the antenna shown in FIG. 5 comprises six co-linear arrays 26 of associated electromagnetic radiating elements 30. The six co-linear arrays 26 include four central co-linear arrays 26*a* and two outermost co-linear arrays 26*b*. The radiating elements 30 are typically dipole elements, although other types of radiating element can be used. The 4-way Butler-matrix feed network 28 has four antenna ports 29 and four radio receiver/transmitter ports 31.

Two of the antenna ports 29 are each connected to a respective one of the two center central co-linear arrays 26*a* by cables 35 and connectors 27 associated with each array. The other two antenna ports 29 are each connected to a feed network port 36 of a respective power divider/combiner 33 by cables 35*a*. Each power divider/combiner 33 is also interconnected by antenna ports 38 to two of the co-linear arrays including one of the outermost co-linear arrays 26*b* and one of the central co-linear arrays 26*a* adjacent to the other outermost co-liner arrays 26*b* by cables 35*b*. Each power divider/combiner 33 either divides or combines RF signals, depending on the operation of the antenna for transmission or receipt of RF signals. For the transmission of RF signals, the power divider/combiner 33 divides the RF signal received from the antenna port 29 of the Butler-matrix feed network 28 into two equal parts, e.g., each of the equal parts has an identical signal characteristic (shape) as the RF signal at a fraction (½) of the signal strength. For the receipt of RF signals, the power divider/combiner 33 combines the RF signals received from the antennas to provide a combined RF signal to the antenna port 29 of the Butler-matrix feed network 28. For example, a 2-way power divider/combiner having reciprocal operation for dividing/combining RF signals may be selected for use as a power divider/combiner 33. The power divider/combiner 33 is selected to have an operating frequency in the frequency range of the antenna with low insertion loss. The power divider/combiners 33 are interconnected to the co-linear arrays 26 by respective cables 35 and connectors 27 associated with each array.

The receiver/transmitter ports 31 are connected to radio receiver and/or radio transmitter equipment 37 by cables 41. The cables 35 interconnected to the two center central co-linear arrays 26*a* are equal phase cables so as not to introduce any phase change with respect to the signals carried thereover relative to each other. Similarly, the effective electrical length of the combined cables 35*a* and 35*b*, power dividers/combiners 33 and connectors 35 and 38 is the same as the cables 35. Therefore, the effective electrical length over all paths between the Butler-matrix feed network 28 and the co-linear arrays 26 is the same. Cables 41 need not be equal phase cables since any phase changes introduced by these cables is not relevant to the electronic beam(s) being used. The radio receiver/transmitter equipment is shown generally in FIG. 5, since the specific type of equipment 37 used in an actual installation can vary widely.

As also seen in FIG. 5, the outermost co-linear arrays 26*b* each comprise one radiating elements, while the central co-linear arrays 26*a* each comprise sixteen radiating elements. The spacing between adjacent elements 30 in the central co-linear arrays 26*a* is preferably approximately λ, where λ is the wavelength of the electromagnetic energy to be received or transmitted. The spacing between adjacent co-linear arrays 26*a*, 26*b* is typically approximately λ/2 (0.47λ for the embodiment shown in FIG. 5).

In general, the Butler-matrix feed network 28 has N antenna ports 29 and N receiver/transmitter equipment ports 31, where N+2 is equal to the number of co-linear arrays of the associated antenna.

As seen in FIG. 5, each radiating element 30 is, in this preferred embodiment, a dipole radiating element. Energy is radiated or received from these dipole elements by means of a feed strap 43 having a centrally located connector 27. The dipole elements 30 are spaced from each adjacent dipole element of the same array by a distance approximately equal to λ. The arrangement of the feed straps 43 with respect to the electrically conductive back plate 47 of the antenna is of a suitable configuration, such as a feed strap configuration known in the art as a Bogner type feed (see U.S. Pat. No. 4,086,598). Since the central co-linear arrays 26*a* have the same number of dipoles, the same trim configurations are used to match the feedlines. The identical trim helps to prevent phase error, which is a cause of side lobes. However, the feed strap configuration of the two outermost co-linear arrays is designed to introduce a phase shift of λ/2 to thereby further reduce side lobe levels.

Figure 6:
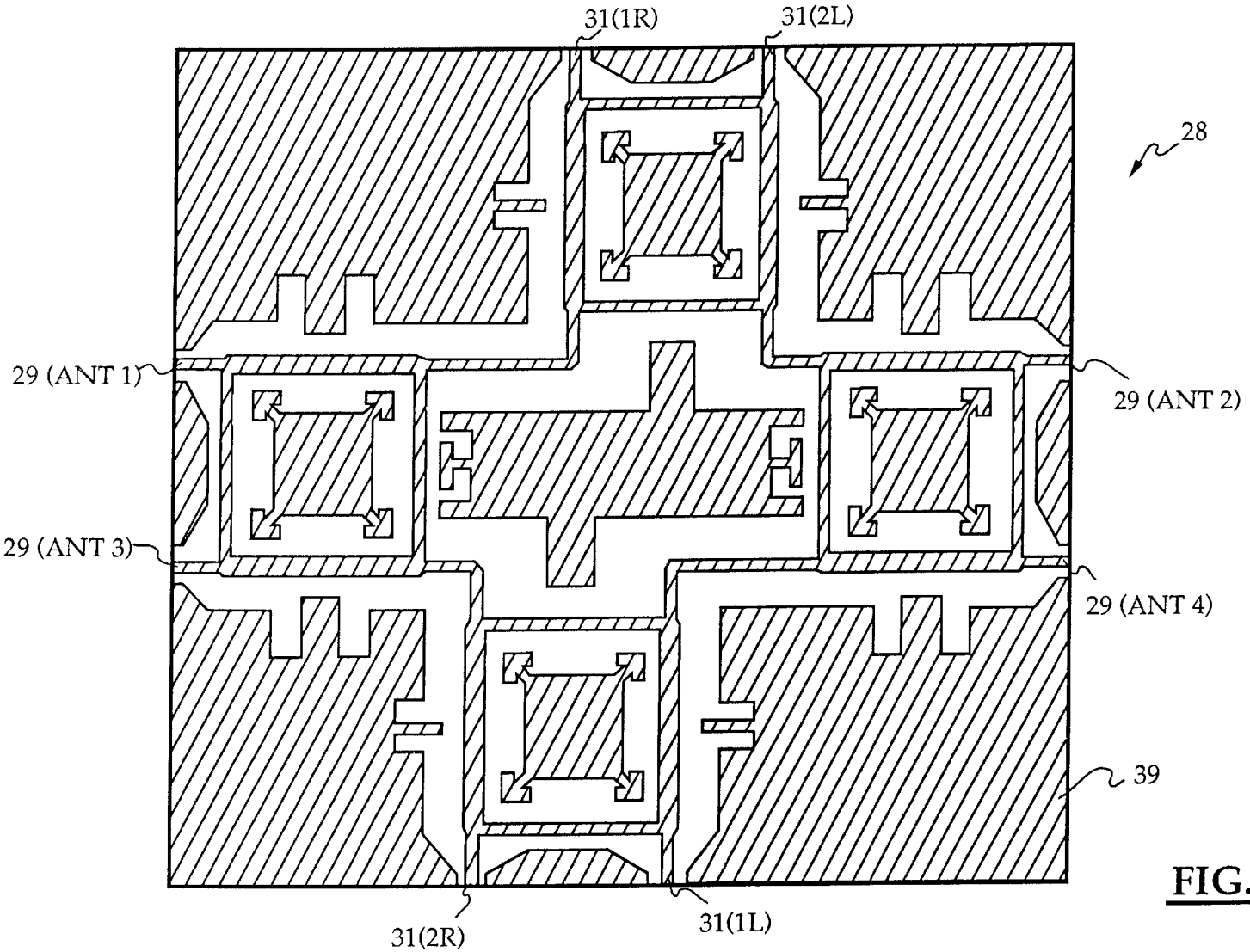
FIG. 6 is a planar view of a printed circuit board microstrip implementation of the 4-way Butler-matrix feed network shown in FIG. 5.

The Butler-matrix feed network 28 for use with the antenna shown in FIG. 5 is best seen in FIG. 6. This implementation uses a planar microstrip design with no crossovers and is fabricated from a printed circuit board 39 having a dielectric substrate made of low loss ceramic material, such as glass epoxy.

Butler-matrix antenna ports 29 are designated ANT1, ANT2, ANT3 and ANT4 corresponding to their respective connections to the co-linear arrays. The two center central co-linear arrays are designated ANT2 and ANT3, respectively. The other two central co-linear arrays are designated ANT1 and ANT4, respectively. The receiver/transmitter ports 31 are designated 2L, 1L, 1R and 2R. Each antenna and receiver/transmitter port comprises an associated coaxial connector.

Figure 7:
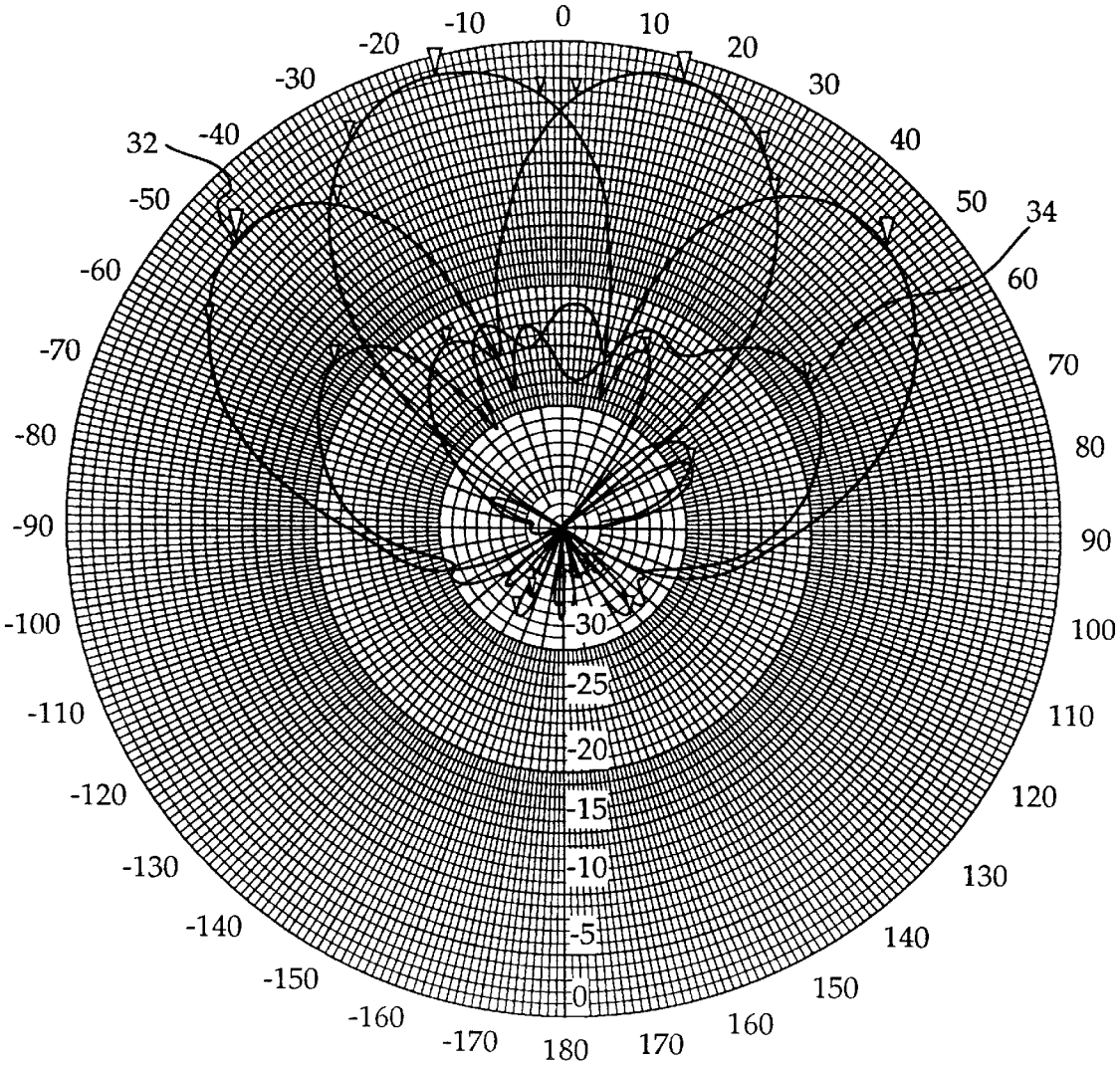
FIG. 7 illustrates the azimuthal electromagnetic radiation (energy) patterns of the four electronically steerable beams at a frequency of 1.850 GHz that can be generated with the antenna system shown in FIG. 5, wherein the azimuthal patterns of all four beams shown in a composite representation.
Figure 8:
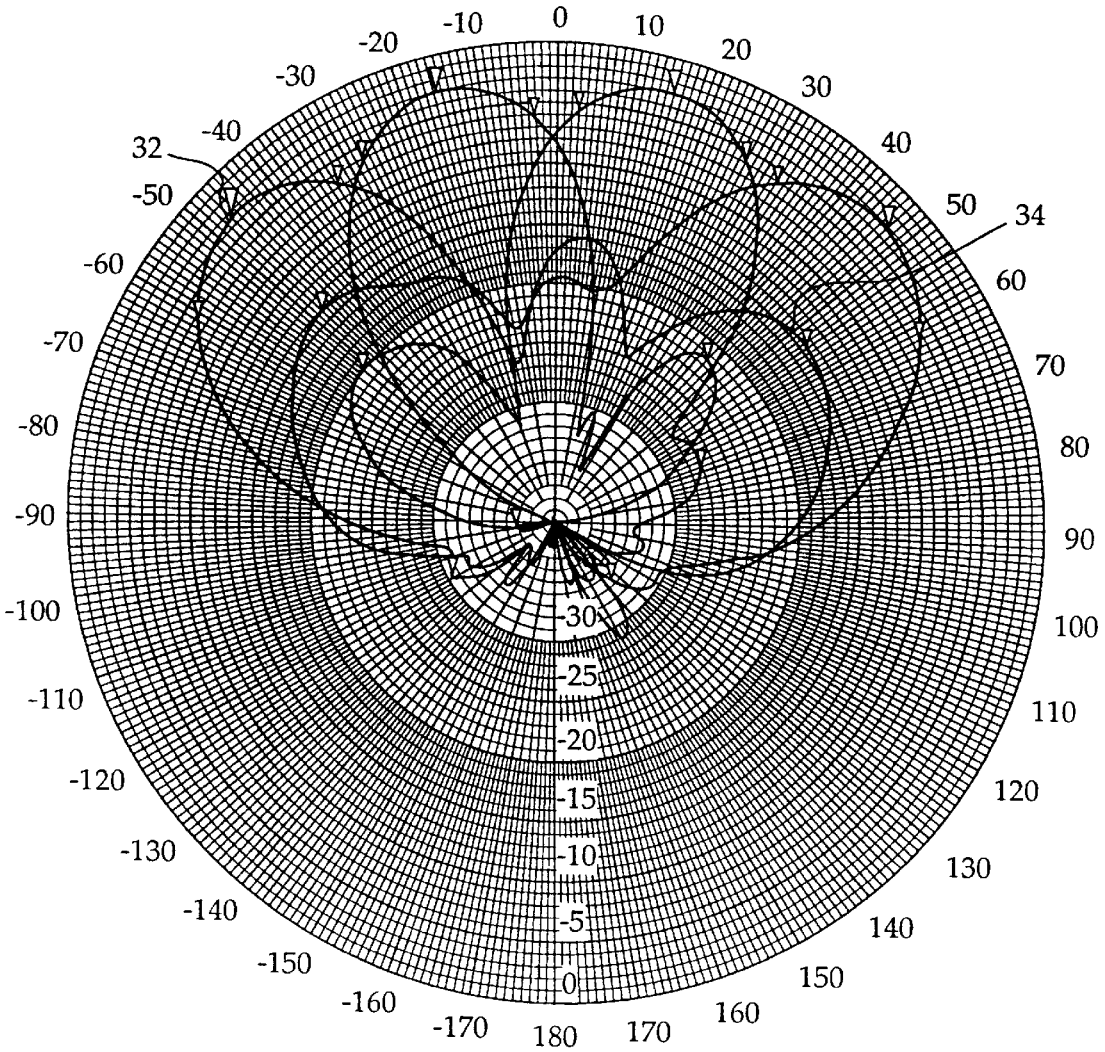
FIG. 8 illustrates the azimuthal electromagnetic radiation (energy) patterns of the four electronically steerable beams of the antenna system of FIG. 5 at a frequency of 1.920 GHz.
Figure 9:
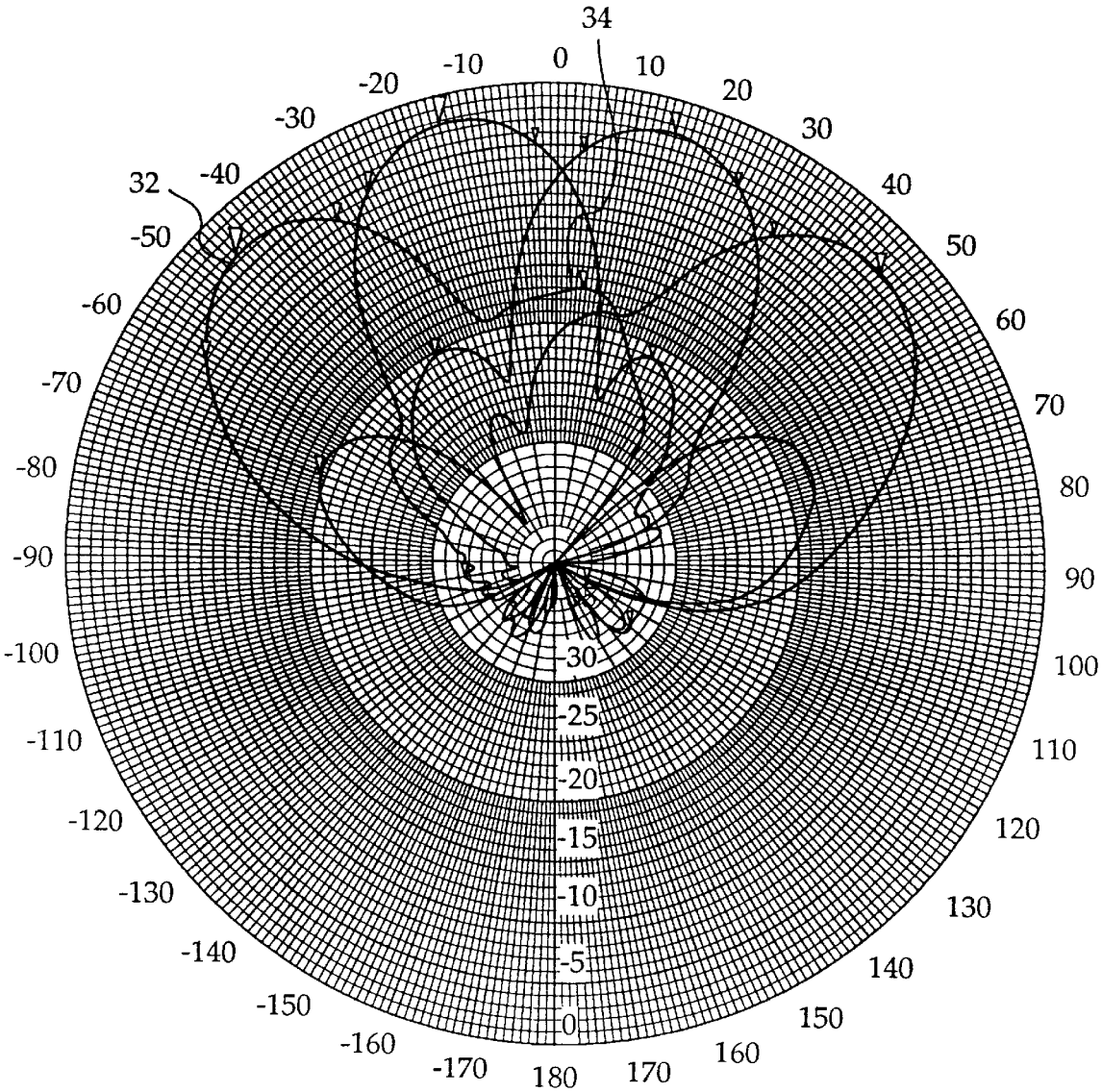
FIG. 9 illustrates the azimuthal electromagnetic radiation (energy) patterns of the four electronically steerable beams of the antenna system of FIG. 5 at a frequency of 1.990 GHz.

FIGS. 7, 8 and 9 illustrate the radiation pattern generated with the antenna system shown in FIG. 5 for frequencies of 1.850 GHz, 1.920 GHz and 1.990 GHz, respectively. The radiation pattern is a composite showing all four radiation beam patterns generated when the 2L, 1L, 1R and 2R Butler-matrix receiver/transmitter ports 31 are respectively used. For example, if the 2L port 31 is driven by a transmitter or if energy is to be received by a receiver at this port, the antenna will have a main lobe 32, designated 2L. As seen in FIGS. 7, 8 and 9, this main lobe has a beam peak at around −46° to −47° and a beamwidth of approximately 27° to 28°. Sidelobe 34 (2L) associated with this main lobe has a peak value which is −10.96 dB to −13.16 less than the main lobe peak value. The data for all the main lobes and the highest associated sidelobes are presented in Tables 1, 2 and 3 below:

TABLE 1

| 1.850 GHz | | |
|---|---|---|
| MAIN LOBE | BEAM PEAK POSITION (DEGREES) | BEAM WIDTH (DEGREES) |
| 2L | −47.82 | 28.20 |
| 1L | −15.34 | 25.88 |

TABLE 1-continued

| 1.850 GHz | | |
|---|---|---|
| 1R | 14.78 | 25.79 |
| 2R | 47.74 | 29.84 |

| SIDELOBE (HIGHEST) | BEAM PEAK POSITION | DIFFERENCE BETWEEN MAIN LOBE PEAK AND SIDELOBE PEAK |
|---|---|---|
| 2L | 58.00 | −11.83 |
| 2L | −152.75 | −27.09 |
| 1L | 25.75 | −22.37 |
| 1L | −155.25 | −32.08 |
| 1R | −30.75 | −20.89 |
| 1R | −64.75 | −26.68 |
| 2R | −53.25 | −12.85 |
| 2R | 141.50 | −26.83 |

TABLE 2

| 1.920 GHz | | |
|---|---|---|
| MAIN LOBE | BEAM PEAK POSITION (DEGREES) | BEAM WIDTH (DEGREES) |
| 2L | −46.86 | 27.90 |
| 1L | −15.28 | 23.96 |
| 1R | 15.10 | 23.86 |
| 2R | 47.09 | 29.49 |

| SIDELOBE (HIGHEST) | BEAM PEAK POSITION | DIFFERENCE BETWEEN MAIN LOBE PEAK AND SIDELOBE PEAK |
|---|---|---|
| 2L | 54.00 | −10.96 |
| 2L | −117.50 | −26.72 |
| 1L | −103.50 | −33.96 |
| 1L | 41.75 | −18.45 |
| 1R | −51.50 | −17.25 |
| 1R | 67.25 | −24.43 |
| 2R | −48.00 | −11.09 |
| 2R | 136.75 | −30.22 |

TABLE 3

| 1.990 GHz | | |
|---|---|---|
| MAIN LOBE | BEAM PEAK POSITION (DEGREES) | BEAM WIDTH (DEGREES) |
| 2L | −46.31 | 27.14 |
| 1L | −14.82 | 23.98 |
| 1R | 14.48 | 23.38 |
| 2R | 47.21 | 28.71 |

| SIDELOBE (HIGHEST) | BEAM PEAK POSITION | DIFFERENCE BETWEEN MAIN LOBE PEAK AND SIDELOBE PEAK |
|---|---|---|
| 2L | −163.75 | −30.06 |
| 2L | 5.25 | −13.16 |
| 1L | −100.5 | −30.18 |
| 1L | 24.75 | −18.92 |
| 1R | −30.25 | −17.73 |
| 1R | 122.50 | −34.00 |
| 2R | −70.50 | −15.80 |
| 2R | 129.50 | −27.96 |

As is seen from the above and FIGS. 7, 8 and 9, the antenna system of the invention provides desired low sidelobe levels over a wide range of frequencies within a frequency band of interest. Using the present invention with one dipole present in the outermost co-linear arrays 26*b* (FIG. 5) with only half of the energy delivered to the outermost co-linear arrays, as little radiation as possible is emitted from the outermost co-linear arrays to minimize the sidelobe levels. Additionally, by providing the identical number of radiating elements in the central co-linear arrays 26*a* (FIG. 5) with the same trim configuration to match feedlines, the radiation pattern of the invention provides a balanced beam pattern with minimized sidelobe levels.

Although the invention is described herein as utilizing six co-linear arrays having central co-linear arrays with identical numbers of radiating elements (dipoles) and two outermost co-linear arrays with only one radiating element (dipole), the principles of the invention can be extended to other antenna configurations having different numbers of co-linear arrays and radiating elements. For example, in an antenna fed by a Butler-matrix feed network having 8 antenna ports and 8 receiver/transmitter ports (N=8), the antenna would be provided with 10 co-linear arrays (N+2), including 8 central co-linear arrays each having an identical number of radiating elements and 2 outermost co-linear arrays having a single radiating element. An example of a Butler-matrix feed network suitable for such an antenna is illustrated in commonly-owned U.S. Pat. No. 5,589,843, the disclosure of which is incorporated herein by reference, particularly with respect to FIGS. 6–12 and the accompany description from column 5, line 24 through column 6, line 49.

In accordance with the principles of the invention, for a Butler-matrix feed network having N ports each for antennas and receivers/transmitters, the corresponding antenna is provided with N+2 co-linear arrays including N central co-linear arrays each having an identical number of radiating elements and 2 outermost co-linear arrays having a single radiating element. The power provided to each of the 2 outermost co-linear arrays is split with one of the central co-linear arrays adjacent to the other outermost co-linear array.

Although the invention has been described and illustrated with respect to exemplary embodiments thereof, the foregoing and various other additions and omissions may be made therein and thereto without departing from the spirit and scope of the present invention.

It is also to be understood that the following claims are intended to cover all the generic and specific features of the invention herein described, and all statements of the scope of the invention which, as a matter of language, might be said to fall therebetween.

We claim:

1. An antenna system comprising:

a multi-beam antenna having a plurality of co-linear arrays positioned with respect to an electrically conductive back plane, including:

a plurality of central co-linear arrays, each central co-linear array having an identical number of electromagnetic radiating elements, the number of electromagnetic radiating elements in each central co-linear array being greater than two, each radiating element within each respective central co-linear array being electrically connected to all other radiating elements in said respective central co-linear array, and at least two additional outermost co-linear arrays, each outermost co-linear array having one electromagnetic radiating element; and phased array feed network means having a plurality of radio receivers/transmitter ports for connection to receiver or transmitter equipment, and a number N of antenna ports, said number N of antenna ports being an integer greater than 1 and being the same as the number of central co-linear arrays;

wherein N−2 of the antenna ports are directly connected to N−2 of the central co-linear arrays, and wherein the two remaining antenna ports are each connected via power divider/combiner means to a respective one of said outermost co-linear arrays and one of said central co-linear arrays adjacent to the other one of said outermost co-linear arrays.

2. The antenna system as claimed in claim 1, wherein said phased array feed network is a microstrip implemented Butler-matrix phased array feed network.

3. The antenna system as claimed in claim 2, wherein said power divider/combiner means includes a power divider/combiner which divides an RF signal received on a feed network port of said power divider/combiner into two parts, each part having an identical signal characteristic and one-half of the signal strength of said RF signal, said parts being provided to a pair of antenna ports of said power divider/combiner, and wherein said power divider/combiner combines received RF signals received on said antenna ports into a combined RF signals which is provided to said feed network port.

4. The antenna system as claimed in claim 2, wherein said electromagnetic radiating elements are dipole radiating elements.

5. The antenna system as claimed in claim 4, wherein each co-linear array includes feed strap means interconnected to each of said elements in each co-linear array, wherein each said feed strap means for said central co-linear arrays implements an identical trim configuration, and wherein each said feed strap means for said outermost co-linear arrays introduces a phase shift of $\lambda/2$, where $\lambda$ is the wavelength of the electromagnetic energy to be received or transmitted.

6. The antenna system as claimed in claim 5, wherein spacing between adjacent elements in said central co-linear arrays is $\lambda$.

7. The antenna system as claimed in claim 6, wherein spacing between adjacent co-linear arrays is approximately $\lambda/2$.

8. The antenna system as claimed in claim 6, wherein spacing between adjacent co-linear arrays is $0.47\lambda$.

9. The antenna system as claimed in claim 1, wherein said power divider/combiner means includes a power divider/combiner which divides an RF signal received on a feed network port of said power divider/combiner into two parts, each part having an identical signal characteristic and one-half of the signal strength of said RF signal, said parts being provided to a pair of antenna ports of said power divider/combiner, and wherein said power divider/combiner combines received RF signals received on said antenna ports into a combined RF signals which is provided to said feed network port.

10. The antenna system as claimed in claim 1, wherein spacing between adjacent elements in said central co-linear arrays is $\lambda$, where $\lambda$ is the wavelength of the electromagnetic energy to be received or transmitted.

11. The antenna system as claimed in claim 1, wherein spacing between adjacent co-linear arrays is approximately $\lambda/2$, where $\lambda$ is the wavelength of the electromagnetic energy to be received or transmitted.

12. The antenna system as claimed in claim 1, wherein spacing between adjacent co-linear arrays is $0.47\lambda$, where $\lambda$ is the wavelength of the electromagnetic energy to be received or transmitted.

13. The antenna system as claimed in claim 1, wherein said electromagnetic radiating elements are dipole radiating elements.

14. The antenna system as claimed in claim 1, wherein each co-linear array includes feed strap means interconnected to each of said elements in each co-linear array, wherein each said feed strap means for said central co-linear arrays implements an identical trim configuration, and wherein each said feed strap means for said outermost co-linear arrays introduces a phase shift of $\lambda/2$, where $\lambda$ is the wavelength of the electromagnetic energy to be received or transmitted.

* * * * *